US007226189B2

(12) United States Patent
Lee et al.

(10) Patent No.: US 7,226,189 B2
(45) Date of Patent: Jun. 5, 2007

(54) LIGHT EMITTING DIODE ILLUMINATION APPARATUS

(75) Inventors: Ming-Shun Lee, Taipei (TW); Ping-Ru Sung, Taipei (TW)

(73) Assignee: Taiwan Oasis Technology Co., Ltd., Taipei (TW)

( * ) Notice: Subject to any disclaimer, the term of this patent is extended or adjusted under 35 U.S.C. 154(b) by 154 days.

(21) Appl. No.: 11/106,550

(22) Filed: Apr. 15, 2005

(65) Prior Publication Data

US 2006/0232974 A1 Oct. 19, 2006

(51) Int. Cl.
*F21V 29/00* (2006.01)

(52) U.S. Cl. ..... 362/294; 362/373; 362/800

(58) Field of Classification Search ..... 362/294, 362/800, 650, 218, 126, 547, 580, 264, 345, 362/373, 240, 230, 231, 612, 555, 545; 361/688, 361/676, 690, 697, 704, 714, 687
See application file for complete search history.

(56) References Cited

U.S. PATENT DOCUMENTS 6,787,999 B2 * 9/2004 Stimac et al. ..... 315/51
6,948,829 B2 * 9/2005 Verdes et al. ..... 362/294
7,059,748 B2 * 6/2006 Coushaine et al. ..... 362/294

* cited by examiner

*Primary Examiner*—Sandra O'Shea
*Assistant Examiner*—Bao Q. Truong
(74) *Attorney, Agent, or Firm*—Troxell Law Office, PLLC

(57) ABSTRACT

The present invention describes a light emitting diode illumination apparatus made of a light bulb base, a heat dissipating device, a plastic lid, a drive substrate, a metal substrate, a circular insulated base and a casing, and the heat dissipating device is in contact with the metal substrate in normal conditions, such that the heat source produced by each light emitting diode is conducted to the heat dissipating device through the metal substrate and then conducted from the heat dissipating device to the light bulb base for effectively dispersing the heat source and maintaining the light emitting efficiency of each light emitting diode.

8 Claims, 4 Drawing Sheets

LIGHT EMITTING DIODE ILLUMINATION APPARATUS

BACKGROUND OF THE INVENTION

1. Field of the Invention

The present invention relates to an illumination apparatus that uses a light emitting diode as a light source, more particularly to a light emitting diode illumination apparatus that can effectively disperse the heat produced by the heat source of the light emitting diode illumination apparatus.

2. Description of the Related Art

As illumination apparatus is an indispensable item for our daily life, and the requirements for modernization and life quality are different, the level of requiring illumination apparatus varies. Tungsten light bulbs and mercury lamps are common traditional illumination apparatus, and the tungsten light bulb converts a vast majority of electric energy into radiated heat during the light emitting process of the tungsten light bulb, and thus the light emitting performance is not high, but the quantity of radiated heat is large. Therefore, the tungsten light bulb is not applicable in the areas with a hotter climate. As to the mercury lamp, although it has a better light emitting performance than the tungsten light bulb, the mercury coated on the internal walls of the lamp causes environmental pollutions when the lamp is dumped. In recent years, many developed countries aggressively invest in the research and development plan of optoelectronic semiconductors, a light emitting diode is developed to replace traditional illumination apparatus.

Light emitting diode is a semiconductor device, and has a better longevity. An LED also features a high efficiency of converting electric energy into light energy, and thus LED requires less power consumption. Compared with traditional light bulbs, the light emitting diode bulb has a lifetime about 50~100 times as that of the traditional light bulbs, and the power consumption of LED is about ⅓~⅕ of that of the traditional light bulbs.

Since a white LED light has the foregoing advantages, therefore the LED lamp is expected to replace tungsten light bulbs and mercury lamps in the $21^{st}$ century and become a new light source for an illumination concurrently implementing the power-saving and environmental protection concepts. However, a general light emitting diode 1 integrates several light emitting diodes 11 (as shown in FIG. 1) sealed by a glass cover body 12, which has difficulty to disperse the heat source produced by the light emitting diode 11 during the light emission. Such light emitting diode light bulbs usually cannot be operated in normal conditions and usually has a high failure rate.

SUMMARY OF THE INVENTION

The primary objective of the present invention is to provide a light emitting diode illuminating apparatus that uses a heat dissipating device and a substrate in contact with each other under normal conditions to conduct a heat source from the substrate to the heat dissipating device and effectively disperse the heat source from the heat dissipating device, so as to maintain the light emitting efficiency of each light emitting diode.

To achieve the foregoing objective, the light emitting diode illuminating apparatus of the invention comprises a light bulb base, a heat dissipating device, a plastic lid, a drive substrate, a metal substrate, a circular insulating base and a casing; wherein the heat dissipating device and the plastic lid are fixed onto the light bulb base; the plastic lid has a circular groove for accommodating the heat dissipating device and the drive substrate; the drive substrate is fixed at the bottom of the circular groove and installs a plurality of electronic components; the heat dissipating device is coated with thermal conductive grease at the top and is in contact with the metal substrate under normal conditions; the metal substrate has a plurality of drive substrates for controlling the light emitting diode; the circular groove has a circular insulating base at the top and a circular edge disposed at the circular insulating base for pressing the drive substrate below, while the internal chamber of the circular insulating base presses and fixes the metal substrate into position; and the circular insulating base has an external casing. A circuit of the drive substrate is connected to a connector, such that the external power supply is connected to a circuit of the drive substrate by the connector, and the drive substrate produces a voltage for each light emitting diode on the metal substrate, so as to achieve the illumination function.

DETAILED DESCRIPTION OF THE PREFERRED EMBODIMENTS

Figure 1:
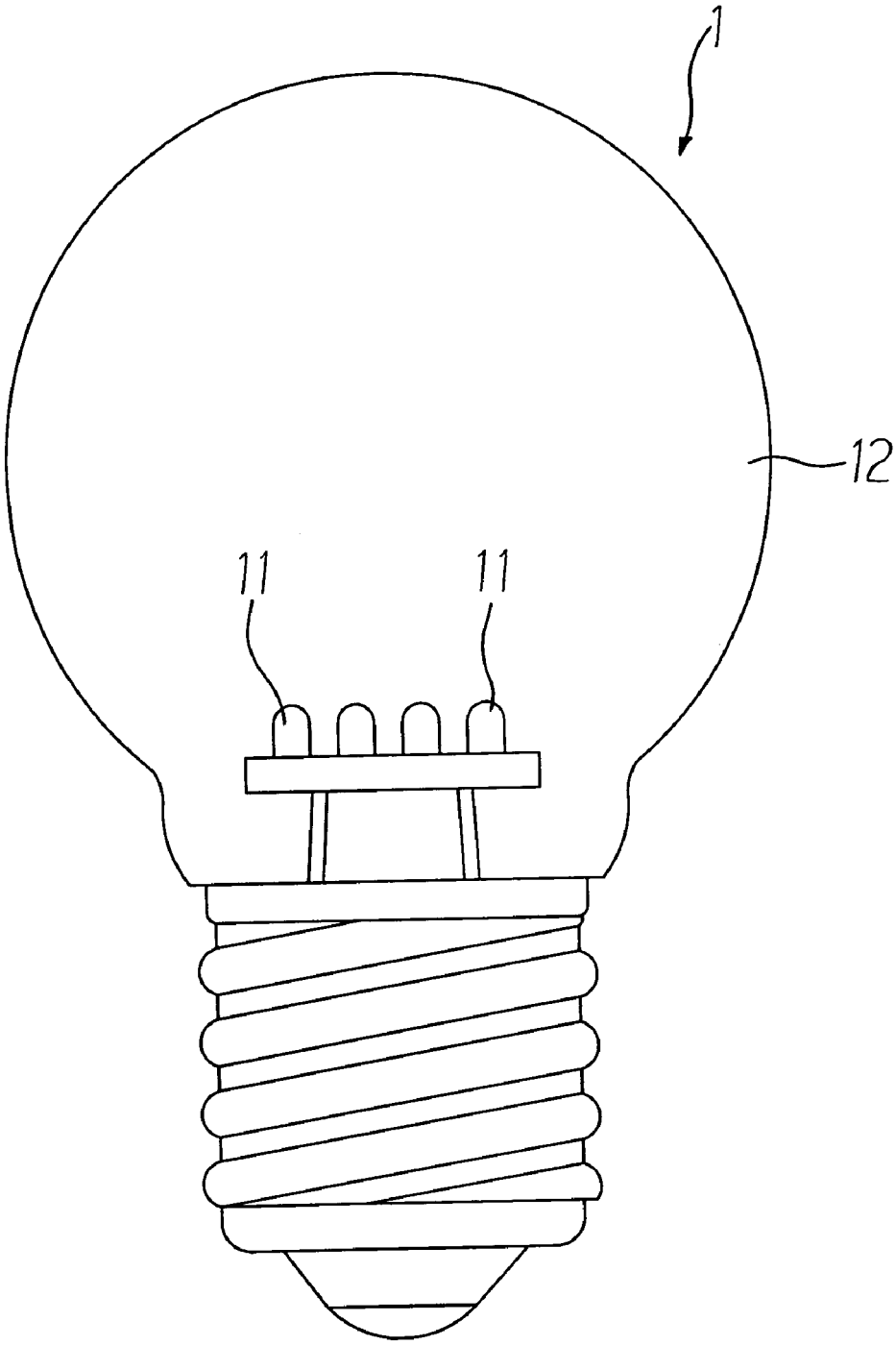
FIG.1 Prior Art
FIG. 1 is a perspective view of the structure of a prior art light emitting diode bulb.
Figure 2:
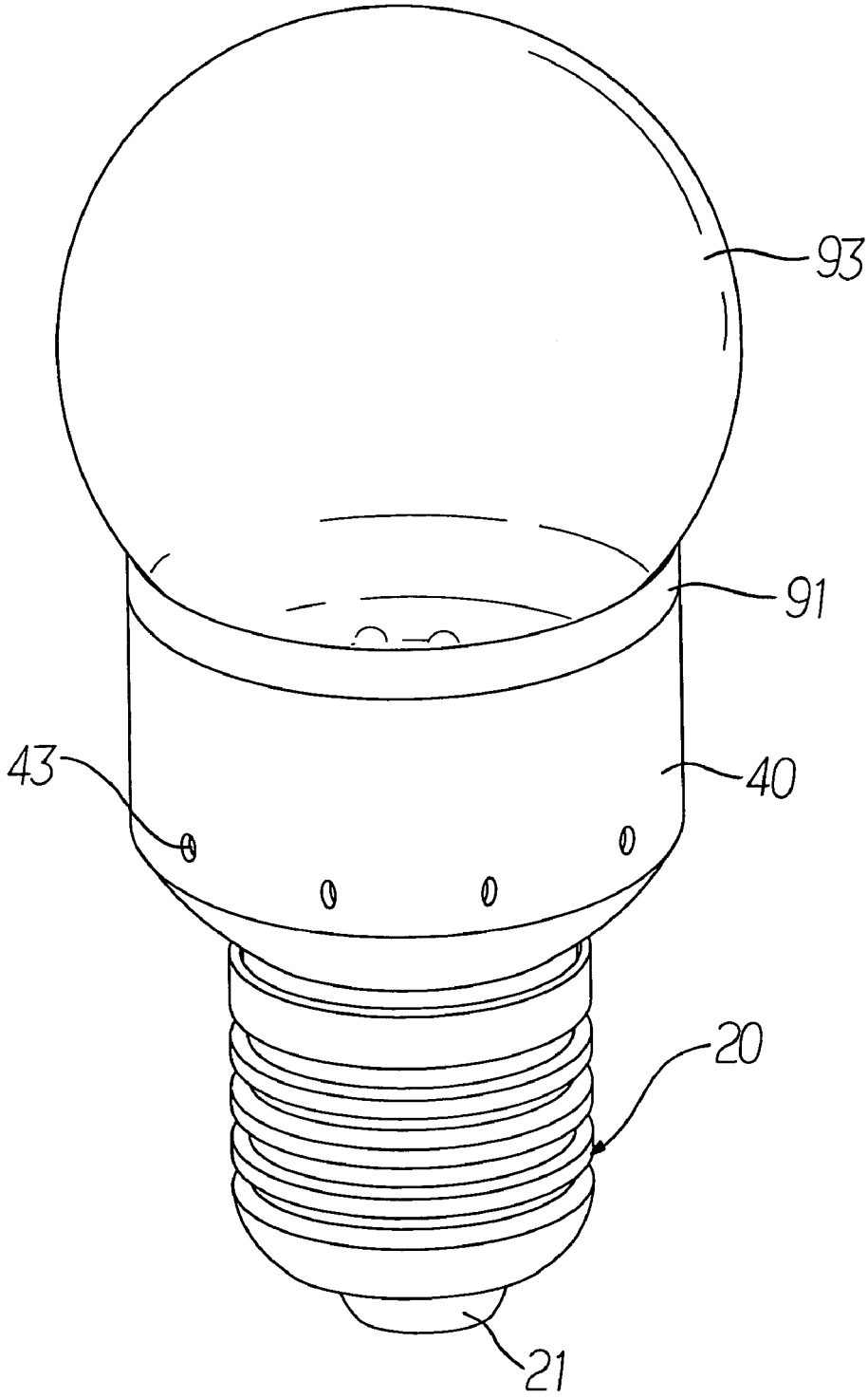
FIG. 2 is a perspective view of the structure of a light emitting diode bulb in accordance with the present invention.
Figure 3:
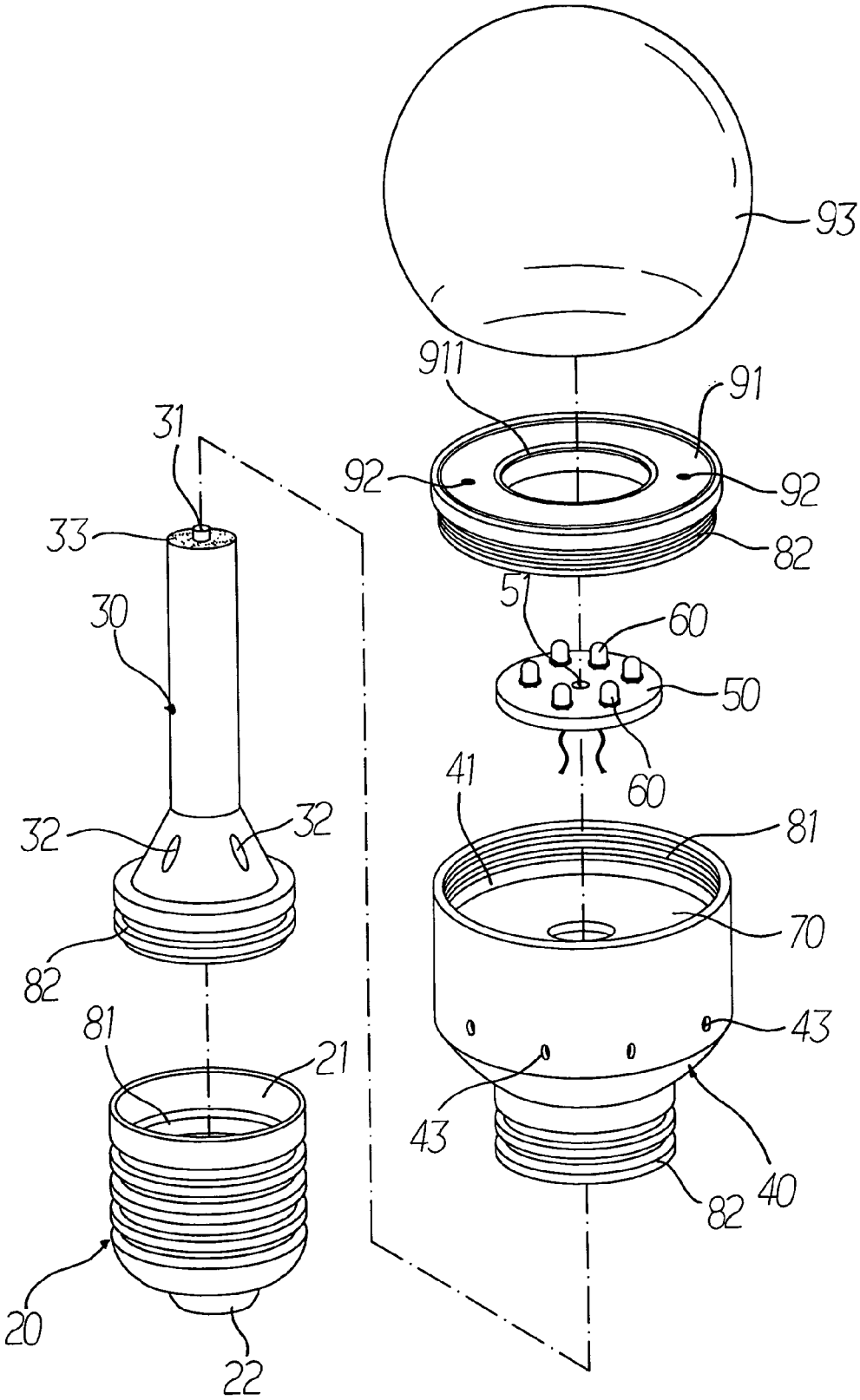
FIG. 3 is an exploded view of the structure of a light emitting diode bulb in accordance with the present invention.

Referring to FIGS. 2 and 3, a basic structural assembly of a light emitting diode illumination apparatus of the present invention comprises:

a light bulb base 20, having a groove base 21 for installing different components and a connector 22 disposed at the bottom for electrically connecting an external circuit, and the groove base 21 has an internal thread 81 for securing a heat dissipating device 30 and a plastic lid 40 onto the groove base 21 in sequence;

a heat dissipating device 30, having an end coupled into the groove base 21 of the light bulb base 20, and the heat dissipating device 30 has an external thread 82 corresponding to the internal thread 81 in the groove base 21, and the other end being contacted with a metal substrate 50 through a thermal conductive grease under normal conditions, and the contact surface of the heat dissipating device 30 and the metal substrate 50 can be engaged with the fixing pillar 31 and the fixing groove 51 according to the preferred embodiment as shown in the figure, and the fixing pillar 31 and the fixing groove 51 are coated with a thermal conductive grease to latch the fixing pillar 31 into the fixing groove 51;

a plastic lid 40, fixed into the groove base 21 and the plastic lid at its lower side having an external thread 82 corresponding to the internal thread 81 of the groove base 21, and the plastic lid 40 having a circular groove 41 for accommodating the heat dissipating device 30 and a drive substrate 70, and the circular groove 41 has a retaining base disposed at an appropriate position on the bottom for fixing the drive substrate 70 into position;

a metal substrate 50 made of a metal material such as a good heat dissipating material or an aluminum based copper clad laminate installed in a circular groove 41 and having a plurality of light emitting diodes 60, and each light emitting diode being controlled by a drive substrate 70, and the drive substrate 70 being coupled with a connector 22;

a circular insulating base 91, having a through hole 92 thereon and being disposed above the circular groove 41, and an internal thread 81 and an external thread 82 are disposed between the circular groove 41 and the circular insulating base 91, such that the circular insulating base 91 is screwed into the circular groove 41, and the circular edge 911 of the circular insulating base 91 can press onto the bottom of the drive substrate 71 and the metal substrate 50, so as to secure the metal substrate 50 onto the heat dissipating device 30, and the circular insulating base 91 has an external casing 93; and an external casing 93, being an arc cover body for wrapping and sealing each light emitting diode 60 therein, which could be made of a high transmission material to increase the brightness of illumination.

Figure 4:
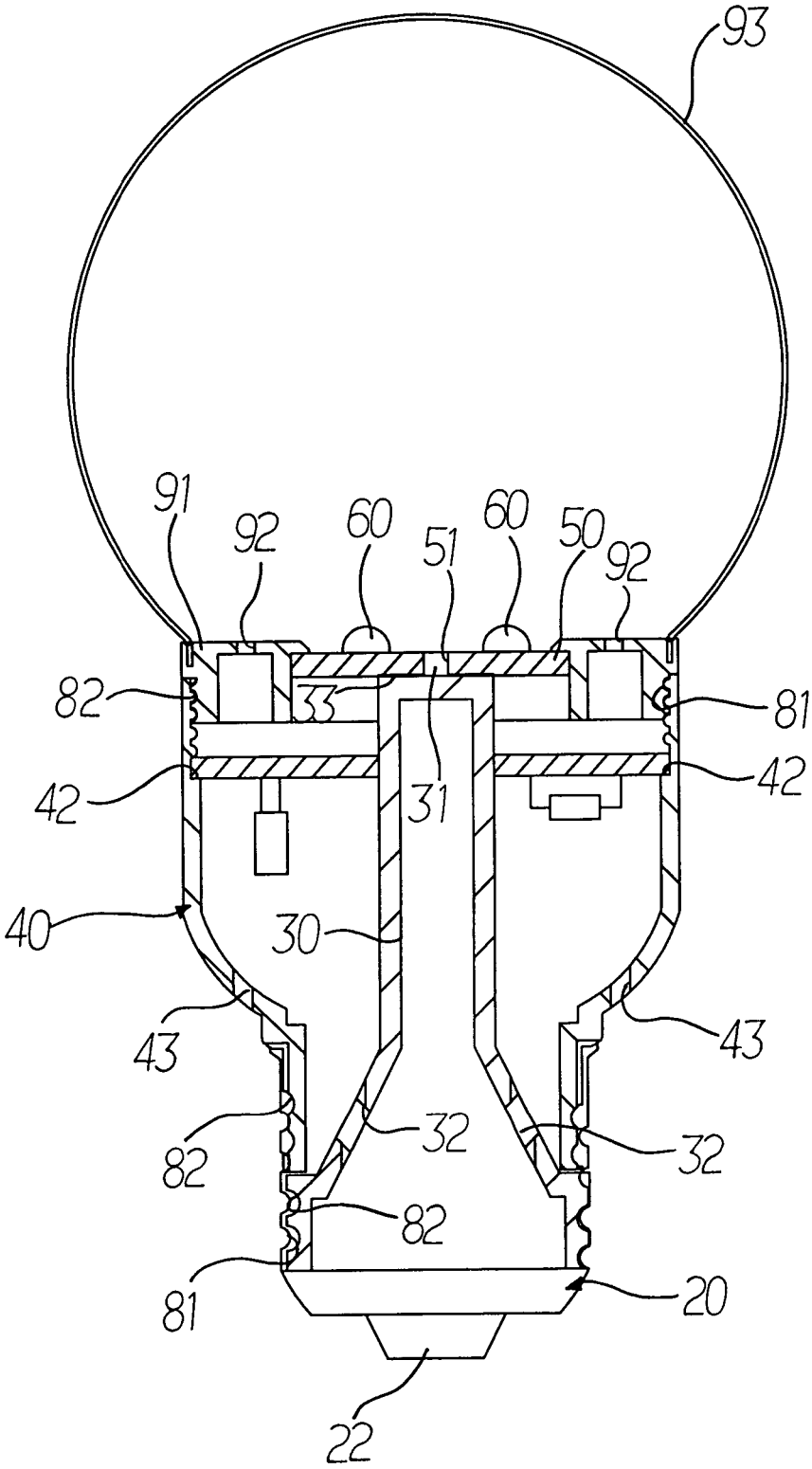
FIG. 4 is a schematic view of the structure of a light emitting diode illumination apparatus in accordance with the present invention.

Referring to FIG. 4 for the whole assembly, the heat dissipating device 30 and the plastic lid 40 are secured onto the circular base 21 in sequence, and the drive substrate 70 is fixed at the bottom of the circular groove 41. The metal substrate 50 having a plurality of light emitting diodes 60 is latched onto the fixing pillar 32 by the fixing groove 51 and further fixes the metal substrate 50 onto the heat dissipating device 30. Finally, the circular insulating base 91 and the fixed cover 92 are screwed into the circular groove 41, so that the circular edge 911 presses the drive substrate 70 below, while pressing and securing the metal substrate 50 onto the heat dissipating device 30, and an external circuit is connected to the drive substrate 70 by the connector 22, and a conductive wire sends electric voltage to the metal substrate 50 to light up the light emitting diode 60, so as to achieve the illumination function.

It is noteworthy that the invention uses a heat dissipating device 30 (could be a cylinder made of a ceramic material) in contact with the metal substrate 50 under normal conditions, such that the heat source produced by the light emitting diodes 60 during the light emission is conducted from the metal substrate 50 to the heat dissipating device 30, and then the heat source is dispersed effectively from the heat dissipating device 30 for maintaining the light emission efficiency of each light emitting diode 60.

Further, the heat dissipating device 30 and the plastic lid 40 can further install a plurality of heat dissipating holes 32, 43 as shown in FIG. 4, so that a convection can be produced between the inside and the outside of the circular groove 41 to disperse the heat source through each heat dissipating hole 43, so as to improve the heat dissipating function.

In summation of the description above, the present provides a light emitting diode illumination apparatus that can effectively disperse the heat source produced by the light emitting diodes during the light emission, which complies with the patent application requirements. The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitting diode illumination apparatus, comprising:

a light bulb base, having a groove base for installing different components and a connector disposed at the bottom for electrically coupling with an external circuit;

a heat dissipating device, having an end coupled into said groove base of said light bulb base and the other end contacted with a metal substrate under normal conditions;

a plastic lid, fixed into said groove base and having a circular groove for accommodating said heat dissipating device and a drive substrate;

the metal substrate, installed in the circular groove base and having a plurality of light emitting diodes, and said each light emitting diode being controlled by said drive substrate, and said drive substrate being coupled with the connector; and a circular insulating base, disposed above said circular groove and having a circular edge for pressing the drive substrate and the metal substrate below for fixing said substrates into position, and said circular insulating base having a casing disposed on said circular insulating base;

such that said heat dissipating device is in contact with said substrates under normal conditions, and a heat source produced by said light emitting diodes is conducted from said metal substrate to said heat dissipating device and dispersed effectively from said heat dissipating device for maintaining a light emitting efficiency of said each light emitting diode.

2. The light emitting diode illumination apparatus of claim 1, wherein said heat dissipating device is a ceramic cylinder having a plurality of heat dissipating holes.

3. The light emitting diode illumination apparatus of claim 1, wherein said groove base has an internal thread, and said heat dissipating device and said plastic lid separately have an external thread in corresponsive to said internal thread, such that said heat dissipating device and said plastic lid are secured onto said circular base in sequence.

4. The light emitting diode illumination apparatus of claim 1, wherein said heat dissipating device has a fixing pillar and the metal substrate has a fixing groove at a surface where said heat dissipating device and said metal substrate are in contact.

5. The light emitting diode illumination apparatus of claim 1, wherein said heat dissipating device and said metal substrate are coated with heat conductive grease at a surface where said heat dissipating device and said metal substrate are in contact.

6. The light emitting diode illumination apparatus of claim 1, wherein said metal substrate could be an aluminum based copper clad laminate.

7. The light emitting diode illumination apparatus of claim 1, wherein said circular groove and said circular insulating base have an internal thread and an external thread for mutually engaged with each other.

8. The light emitting diode illumination apparatus of claim 1, wherein said circular groove forms a retaining base at an appropriate position of the bottom for fixing said drive substrate into position.

* * * * *